United States Patent [19]

Serex

[11] Patent Number: 4,556,252

[45] Date of Patent: Dec. 3, 1985

[54] PORTABLE SKI REST

[76] Inventor: Vern L. Serex, 5386 Aster St., NW., Salem, Oreg. 97034

[21] Appl. No.: 466,131

[22] Filed: Feb. 14, 1983

[51] Int. Cl.[4] ..... A47C 9/12

[52] U.S. Cl. ..... 297/438; 297/423

[58] Field of Search ..... 297/423, 438, 466, 4; 5/443, 444; 182/9

[56] References Cited

U.S. PATENT DOCUMENTS

| | | | |
|---|---|---|---|
| 402,130 | 4/1889 | Bedford | 297/438 X |
| 1,721,516 | 7/1929 | Jacobs | 182/9 |
| 3,062,580 | 11/1962 | Jasmin, Jr. | 297/4 |
| 3,474,781 | 10/1969 | Gaylord, Jr. | 297/466 X |
| 3,776,540 | 12/1973 | Comando | 5/443 X |
| 3,840,091 | 10/1974 | Conlon | 182/9 |
| 4,013,318 | 3/1977 | Piper | 297/438 |
| 4,198,716 | 4/1980 | Hollyday, III | 297/438 X |
| 4,358,138 | 11/1982 | Laughlin et al. | 297/438 X |

*Primary Examiner*—Philip C. Kannan

*Attorney, Agent, or Firm*—Chernoff, Vilhauer, McClung, Birdwell & Stenzel

[57] ABSTRACT

A portable ski rest is provided for use on a ski lift chair to support the skis of a skier seated thereon. The portable ski rest includes a ski support member upon which the skier's skis rest. The ski support member is suspended on an elongate flexible cord from a bracket which is placed between the skier's thighs and the chair seat. The elongate flexible cord is woven through the bracket and connects to a belt worn at the skier's waist. When the skier places his feet and skis on the ski support member, their full weight is transmitted by a first section of the flexible cord extending between the bracket and ski support member as a tensile force to the bracket. The section of flexible cord extending between the bracket and the belt transmits a tensile force which is less than the force in the first section, the balance of the force being borne by the chair seat. A carrier is provided on the belt for carrying the ski support member in a stowed, portable position when the ski rest is not in use.

6 Claims, 5 Drawing Figures

PORTABLE SKI REST

BACKGROUND OF THE INVENTION

This invention relates to a ski rest device, and more particularly to a device for supporting the feet of a person seated on a ski lift and wearing skis. The invention further contemplates a ski support which can be retained in a compact, portable configuration when not in use.

In the sport of skiing, it is frequently the case that a skier seated on an elevated ski lift chair will experience fatigue and pain in the muscles of his legs which dangle unsupported over the edge of the chair. The fatigue and pain result from the strain imposed by the downward pull of the skis and boots which the skier wears on his feet. In order to relieve that strain, some ski lift chairs are provided with a rail or bar which pivots downwardly from above the chair to provide a place for the skier to rest his feet and skis while riding on the lift chair. However, such bars are not portable and cannot readily be transferred to lift chairs not provided with them.

One drawback of providing a bar on a chair lift for ski support is that, because its supporting surfaces are not readily adjustable with respect to the chair seat, it may provide no support to a skier with short legs, or uncomfortable support to a skier with long legs. Moreover, the position of the bar beneath the chair seat when in use can present a problem when the skier is rising from the lift chair. During these times, if the skier forgets to pivot the bar upwardly prior to dismounting, or if the pivoting structure jams, the bar beneath the chair poses the danger of either blocking or deflecting the skis, which can result in the skier falling and possibly injuring himself.

Other devices which relate to the problems of carrying and transporting skis, but which do not directly address the problem of supporting skis while they are being worn by a skier seated in a chair lift, are well known. These ski-carrying devices fall into one of two general categories: (1) a device which attaches to some part of the skier's body; and (2) a device which adapts a knapsack or rucksack so that it may be used to also carry skis. Exemplary of devices in the first category are Hogensen, Jr., U.S. Pat. No. 3,920,166, Hogensen, Jr., U.S. Pat. No. 3,841,542, Helmert, U.S. Pat. No. 2,530,695, Willmarth, U.S. Pat. No. 3,854,640, Altorfer, U.S. Pat. No. 2,224,568, Windheim, U.S. Pat. No. 2,118,875, and Hall, U.S. Pat. No. 4,308,982. Examples of devices in the second category include Meiss, Swiss Pat. No. 209,479, and Tveito, Norweigan Pat. No. 81,396. However, such prior art ski carriers, besides being suitable generally just for carrying skis which are not being worn, are useful to the skier only while he is on foot. They are not intended to support skis worn by the skier when he is seated in a lift chair.

Thus, the prior art does not provide a portable ski rest which can be carried to and used on lift chairs not otherwise having a means for supporting the skis of persons using those chairs. The integral lift chair ski rest bar of the prior art is not adaptable to be portable and to be used with a variety of different ski lift chairs. In certain circumstances, the prior art ski rest bar may be uncomfortable or unsafe.

SUMMARY OF THE PRESENT INVENTION

The primary object of the present invention is to provide a portable ski rest which solves the aforementioned problems with respect to supporting the feet and skis of the user of a ski lift by providing a portable ski rest which may be carried by a skier, to be used while he is seated on a ski lift chair which has no means for supporting the skier's skis.

The foregoing capability is accomplished by the provision of a ski support member, a support device for supporting the ski support member, and an elongate flexible cord for interconnecting the ski support member and the support device in such a manner that the ski support member is suspended beneath the support device in an operative position for supporting the user's skis or feet while the user is seated on a lift chair. The ski rest also has provision for detachably holding the ski support member in a compact, portable position adjacent the support device, which enables the ski rest to be easily carried by the skier when it is not in use.

The support device of the portable ski rest includes a belt which can be detachably worn by the skier, and further includes a bracket which can be positioned between the skier's thighs on the chair lift seat when the ski support member is suspended in its operative position. When the ski support member is suspended in its operative position, a first tension-resistant section of the flexible elongate cord extends between the ski support member and the deployed bracket, suspending the ski support member beneath the bracket, and a second tension-resistant section extends between the bracket and the belt for partial support of the bracket. This arrangement provides for transferring to the bracket the entire tension placed on the first section of the flexible cord by the weight of the skier's skis and boots, while the second section of the flexible cord transfers to the belt less than the full tension felt by the first section, the difference being supported by the chair seat.

A further salient feature of the invention is the provision of adjusting devices which allow the user to vary the distance between the bracket and ski support member and between the bracket and belt so that the user can adapt the portable ski rest of the invention to his individual dimensions.

Further, because the portable ski rest is deployed after the skier is seated on a lift chair, it will not hinder him while he is being seated thereon. Finally, the portable ski rest of the invention is provided with a means for automatically disengaging from the skier in the event he forgets to remove it prior to leaving the lift chair, which prevents the ski rest from interferring with the skier's maneuvers at that time. Both features contribute to the safety of use of the invention.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 1:
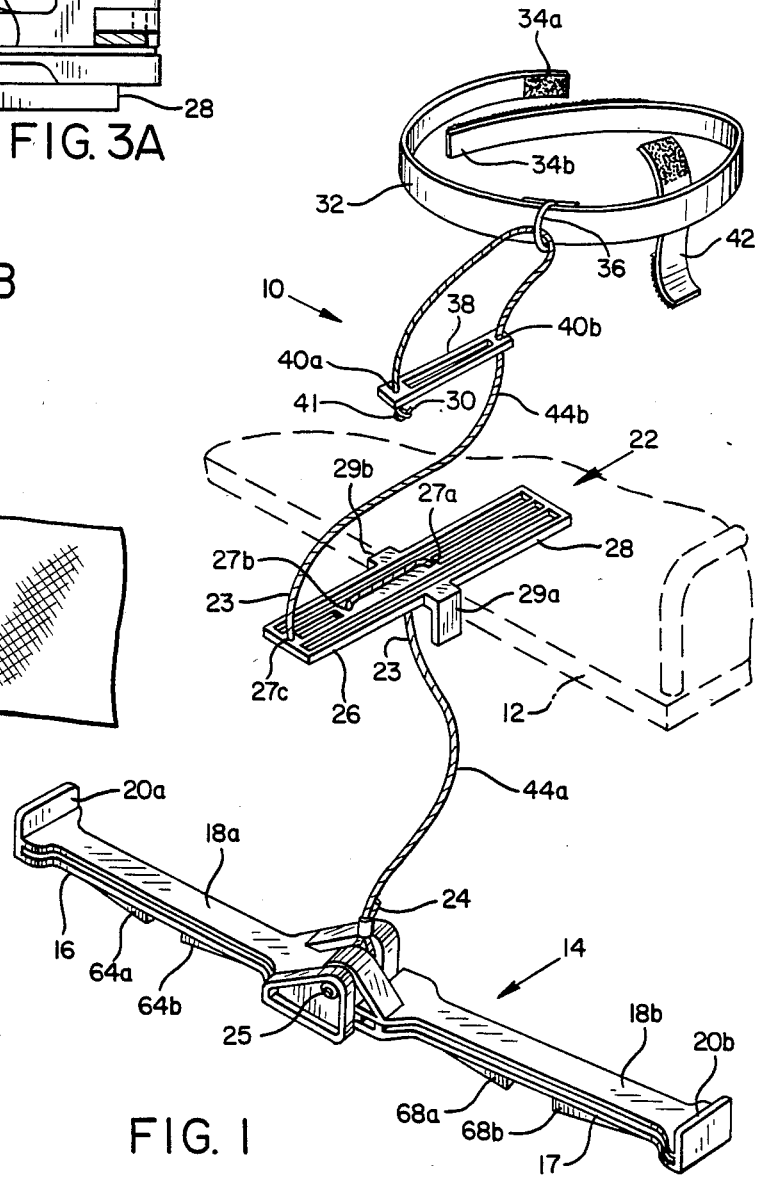
FIG. 1 is a perspective view of an exemplary portable ski rest with the ski support member deployed in an operative position.

FIG. 1 depicts a portable ski rest, indicated generally as 10, which is used by a skier while the skier is seated on a ski lift chair 12. The portable ski rest 10 includes a ski support, indicated generally by 14, the ski support 14 comprising two sections 16 and 17. The section 16 includes a surface 18*a* upon which the bottom of one of the skier's skis rests, and a raised edge 20*a* at the end of the surface 18*a*, which keeps the ski from sliding laterally off of the surface. The section 17 has a corresponding ski engaging surface 18*b* and a retaining edge 20*b*.

A substantially flat support bracket, indicated generally by 22, is connected to the ski support 14 by means of an elongate flexible cord 23. One end 24 of the flexible cord 23 is wound around a rivet 25 which joins the ski support sections 16 and 17 for a purpose described hereinbelow, and is fixedly clamped onto the flexible cord 23. The support bracket 22, shown in operative engagement with the ski lift chair 12, includes a cantilevered end 26 having holes 27*a*, 27*b* and 27*c* through which the flexible cord 23 is woven in a first loop which extends between the holes 27*a* and 27*b*, and a second loop which extends between the holes 27*b* and 27*c*. The support bracket 22 also includes a rearward end 28 which is shown resting on the upper surface of the lift chair 12. A pair of flanges 29*a* and 29*b* extend in the same direction perpendicularly to the support bracket 22. The flanges may be formed in or otherwise fixedly attached to the support bracket 22.

A belt 32 is provided for fitting around the waist of the skier. The ends 34*a* and 34*b* of the belt 32 are fastened together to hold the belt in place around the skier's waist. In the preferred embodiment, the ends are attached by a releasable fastener which may comprise a pair of mating Velcro hook-and-loop pieces, each piece being attached to a respective end of the belt in an opposing relationship to the other piece. A D-ring 36 is fixedly attached to the belt 32 intermediate its ends, and provides a point of attachment for the flexible cord 23. The flexible cord 23 is attached to the belt 32 by means of the cord length adjuster 38, the end 30 of the flexible cord being led first through adjuster hole 40*b*, then through the D-ring 36, and finally through adjuster hole 40*a* wherein it is held by any appropriate retaining means, such as the knot 41.

A holder 42, which may comprise, for example, mating pieces of Velcro, is fixedly attached to the belt 32 for detachably holding the ski support 14, the support bracket 22 and the flexible cord 23 in a portable position on the belt 32, as explained in greater detail hereinbelow.

When the portable ski rest 10 is deployed for its intended operation, the belt 32 is attached to the skier's waist by fastening the ends 34*a* and 34*b* together. The belt 32 is so constructed that the fastened-together ends 34*a* and 34*b* and the holder 42 are on opposite sides of the belt, with the D-ring located substantially halfway therebetween. With this construction, when the belt 32 is attached to the skier's waist, the fastened-together ends 34*a* and 34*b* and the holder 42 will be located on opposite sides of the skier's waist, and the D-ring 36 will be in front of the skier.

When he has been seated on the lift chair 12, the skier can position the bracket 22 so that the rearward portion 28 is releasably supported on the seat of the chair 12 between the skier's thighs, and so that the cantilevered end 26 of the bracket will project outwardly over the edge of the chair 12. The support bracket 22 is oriented so that the perpendicular flanges 29*a* and 29*b* extend downwardly toward the ski support 14 and contact the forward edge of the chair 12, thereby preventing the support bracket 22 from rotating or sliding further backwardly underneath the skier. This maintains the holes 27*a*, 27*b* and 27*c* forwardly of the edge of the chair, thereby keeping the flexible cord 23 from any damaging frictional contact with the edge. With the belt 32 and the support bracket 22 thus deployed, the ski support 14 will be suspended on the flexible cord 23 in an operative position beneath the chair 12 where the skier can rest his skis on the surfaces 18*a* and 18*b*.

While the ski rest 10 is in operative use, with the skier seated on the chair 12 and his skis resting on the ski support 14, the weight of the skis and boots will be transmitted as a tensile force in the section 44*a* of the flexible cord 23, the section 44*a* extending between the support bracket 22 and the ski support 14. The weaving of the flexible cord 23 in the holes 27*a*, 27*b* and 27*c* of the support bracket 22 holds the cord in a fixed frictional engagement with the support bracket 22, which thereby transmits all of the force in the cord section 44*a* to the support bracket 22. In the position shown in FIG. 1, the support bracket divides the force imposed upon it by the cord section 44*a* between the seat of the chair 12 and the cord section 44*b* which extends between the support bracket 22 and the belt 32. It is evident that the support bracket acts as a force translator lever, by the action of which the tension in the cord section 44*a* is much greater than the tension in the cord section 44*b*. Thus, the tug on the belt 32 imposed by the weight of the skis and boots is much less than the actual force required to support the skis and boots.

The provision of the holes 27*a*, 27*b* and 27*c* in the support bracket 22 and the cord length adjuster 38 permit the length of the portable ski rest 10 to be adjusted in order to accommodate the bodily dimensions of any particular user. Prior to initial use, the skier adjusts the length of the cord section 44*a* such that it approximates the length from his knee to the bottom of his feet, which is accomplished by slidably adjusting the position of the support bracket 22 relative to the flexible cord 23. Then the length of the cord section 44*b* is set by slidably adjusting the position of the cord length adjuster 38 such that, when the skier is seated on the ski lift chair 12, with the support bracket 22 resting on the edge of the chair 12 between his thighs, the D-ring 36 will impose an upward pull on the cantilevered end 26 of the support bracket 22. These adjustments, once made, are retained from use-to-use, and no further adjustments are necessary unless the ski rest is transferred to a different skier or unless the skier assumes a different posture on the chair, in which case the length of the cord section 44*b* might be readjusted.

It is evident that the structure of the portable ski rest described hereinabove can be modified without departing from the spirit of the invention. For example, the ski support 14 could be suspended from a chair-engaging bracket alone, and either the bracket 22 or chair 12 could be modified to more securely connect the bracket to the chair. For example, the chair seat could be provided with a slot into which the bracket would slide. Alternatively, the ski support 14 could be suspended from a belt alone, although this would impose an undesirably high degree of tension on the belt.

Figure 2A:
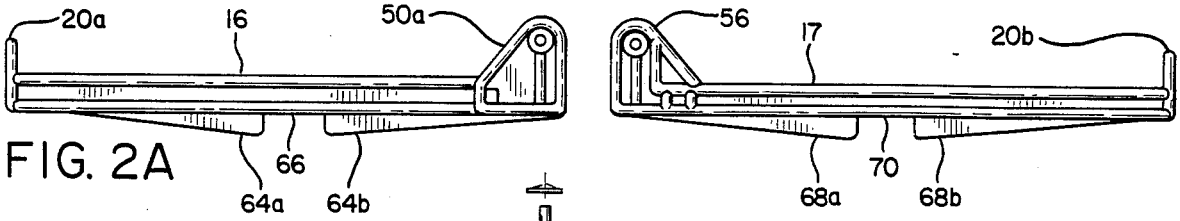
FIGS. 2A and 2B are exploded views showing the assembly of the ski support member, with FIG. 2A being a side view, and FIG. 2B being a top view.
Figure 2B:
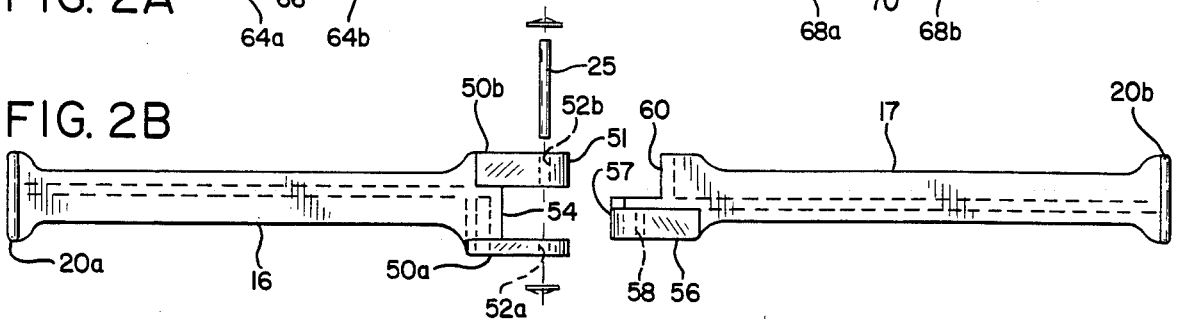

FIGS. 2A–3B illustrate the features of the invention which permit the ski support 14, the bracket 22 and the flexible cord 23 to be placed in a compact, portable configuration which may be carried adjacent to the belt 32 when the portable ski rest 10 is not in use. As seen in FIGS. 2A and 2B, the ski support section 16 comprises a pair of gudgeons 50*a* and 50*b* which form a clevis at the end of the section 16 opposite the raised edge 20*a*. The gudgeons 50*a* and 50*b* have a pair of axially aligned holes 52*a* and 52*b*. Gudgeon 50*b* has a front stopping surface 51 formed thereon. Another stopping surface 54 is formed in a portion of the section 16 between the gudgeons 50*a* and 50*b*. The section 17 comprises a single gudgeon 56 having a front stopping surface 57. The gudgeon 56 also has a hole 58 bored therethrough. A stopping surface 60 is formed in the section 17 laterally of the gudgeon 56.

The ski support 14 is assembled by placing the two sections 16 and 17 end-to-end with gudgeon 56 oriented between the gudgeons 50*a* and 50*b* such that the holes 52*a*, 52*b*, and 58 are coaxially aligned so that the rivet 25 can be inserted therethrough and thereafter seated in place. With this structure, the ski support 14 can be placed in an unfolded configuration when it is to be used for supporting skis by rotating the sections 16 and 17 about the rivet 25 until they are colinear. The sections 16 and 17 are held in this position by the stopping action of the gudgeon surfaces 51 and 54 against the stopping surfaces 60 and 57, respectively.

Conversely, the sections 16 and 17 may be rotated with respect to each other about the rivet 25 until they are stopped in a substantial parallel, folded alignment wherein the raised edges 20*a* and 20*b* contact each other.

Figure 3A:
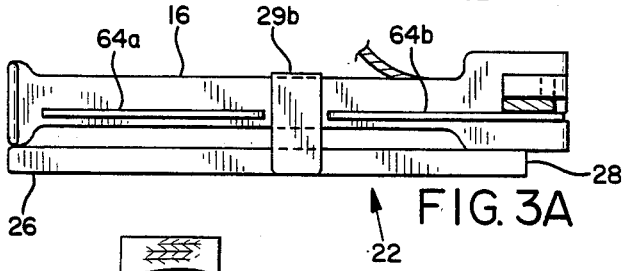
FIG. 3A is a simplified top view showing the portable ski rest of the invention in its portable configuration with the folded ski support member interconnected with the bracket.
Figure 3B:
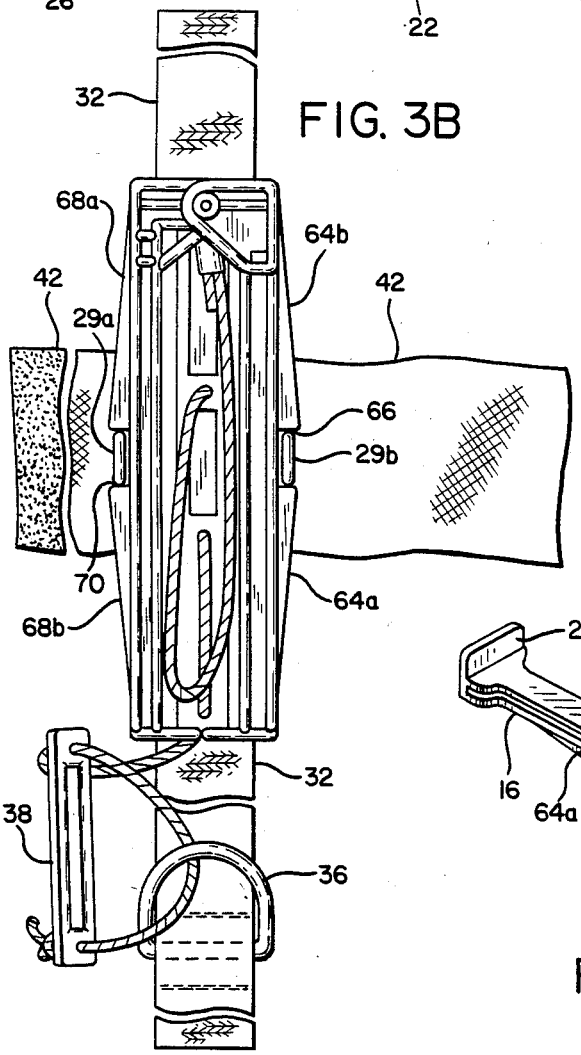
FIG. 3B is a side view illustrating the same arrangement of parts as in FIG. 3A, in position preparatory to being detachably connected to the user's belt.

The ski support section 16 has formed on its lower surface a pair of sloping flanges 64*a* and 64*b* which are colinearlly aligned to form a notch 66 between their opposing faces. Similarly, the ski support section 17 has flanges 68*a* and 68*b* forming a notch 70. As illustrated in FIG. 3A, when the sections 16 and 17 are rotated into a substantially parallel, folded alignment, the notches 66 and 70 are aligned so as to permit perpendicularly protruding flanges 29*a* and 29*b* of the support bracket 22 to fit thereinto in a close sliding engagement. This allows the support bracket 22 to fit over one side of the ski support 14 when the ski support is folded into its closed, portable position. Thus arranged, the support bracket 22 and the ski support 14 form a convenient five-sided space wherein a portion of the flexible cord 23 may be coiled. This arrangement of the ski support 14, support bracket 22, and flexible cord 23 provides a convenient compact configuration which may be detachably carried in the holder 42 adjacent the belt 32. The holder 42 may comprise, for example, mating pieces of Velcro fixedly attached to the belt 32 whose ends may be fastened together over the folded ski support and interconnected bracket assembly, which will hold the flexible cord 23 within the space defined by the ski support 14 and support bracket 22 until the skier is again ready to use the portable ski rest 10 in the manner described hereinabove.

In the present embodiment, the ends 34*a* and 34*b* of the belt 32 are held together by a pair of mating Velcro pieces, which imparts a significant safety feature to the portable ski rest 10. Should the skier accidentally forget to remove the ski rest prior to leaving the lift chair 12, the belt 32 will automatically disengage from the skier's waist by the Velcro pieces pulling apart under the increased tension which would be applied to the flexible cord 23 when the skier stands to leave the chair and the ski support 14 is pinned between the bottom of his skis and the ground.

In the preferred embodiment, the ski support sections 16 and 17 and the support bracket 22 are constructed from a strong, lightweight material such as molded plastic. The flexible cord can comprise any strong synthetic or natural material which is suitable for the purposes hereinabove described.

As used herein, the term portable ski rest is not necessarily limited to a device used only for skis or on ski lift chairs. It is evident that the portable ski rest of the invention can also be used to support the feet of a user who is not wearing skis, and that the user may be seated on any surface having an edge over which his legs extend.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A portable foot rest, for supporting the feet of a person while said person is seated on a ski lift and wearing skis, boots or the like, comprising:

(a) rigid elongate first support means for supporting said person's feet;

(b) second support means for supporting said first support means;

(c) elongate means for interconnecting said first support means and said second support means and for supporting said first support means in an operative position remote from and below said second support means; and (d) said second support means including belt means for supportably encircling the waist of said person and, by means of support from said waist, supporting said first support means in said operative position while said person is seated on said ski lift.

2. The portable foot rest of claim 1 wherein said second support means further comprises bracket means for detachably supportably engaging said ski lift when said first support means is in said operative position and for supporting said first support means in said operative position simultaneously with said belt means, said elongate means comprising a first tension-resistant section extending between said bracket means and said first support means, and a second tension-resistant section extending between said belt means and said bracket means, said bracket means including cantilever lever means for transferring only a portion, less than all, of the tension in said first tension-resistant section to said second tension-resistant section when said first support means is in said operative position and said bracket means is supportably engaging said ski lift.

3. The portable foot rest of claim 2 further comprising a first adjusting means for disposing said first support means in a variably adjustable spaced relationship with said bracket means when said first support means is in said operative position, and a second adjusting means for disposing said bracket means in a variably adjustable spaced relationship with said belt means when said bracket means is engaging said ski lift.

4. A portable foot rest, for supporting the feet of a person while said person is seated on a ski lift and wearing skis, boots or the like, comprising:

(a) first support means for supporting said person's feet;

(b) second support means for detachably engaging said ski lift and supporting said first support means;

(c) flexible, tension-resistant elongate means for interconnecting said first support means and said second support means and for supporting said first support means in an operative position a spaced distance from and below said second support means; and (d) safety means on said second support means for releasably disengaging said second support means from said ski lift automatically in response to tension in said elongate means in excess of a predetermined maximum tension.

5. The portable foot rest of claim 4 wherein said second support means includes belt means for supportably encircling the waist of said person and, by means of support from said waist, supporting said first support means in said operative position when said person is seated on said ski lift, said safety means including means on said belt means for releasably disengaging said belt means from said person's waist automatically in response to tension in said elongate means in excess of a predetermined maximum tension.

6. The portable foot rest of claim 1 including safety means on said belt means for releasably disengaging said belt means from said person's waist automatically in response to tension in said elongate means in excess of a predetermined maximum tension.

* * * * *